US007278933B2

(12) United States Patent
Kang

(10) Patent No.: US 7,278,933 B2
(45) Date of Patent: Oct. 9, 2007

(54) DIMPLE PATTERN ON GOLF BALL

(75) Inventor: Hye Sook Kang, Seoul (KR)

(73) Assignee: Hanyoung Kangaroo Co., Ltd. (KR)

( * ) Notice: Subject to any disclaimer, the term of this patent is extended or adjusted under 35 U.S.C. 154(b) by 0 days.

(21) Appl. No.: 11/439,090

(22) Filed: May 23, 2006

(65) Prior Publication Data

US 2006/0276267 A1 Dec. 7, 2006

(30) Foreign Application Priority Data

May 23, 2005 (KR) ..... 10-2005-0043133

(51) Int. Cl.
*A63B 37/12* (2006.01)

(52) U.S. Cl. ..... 473/383

(58) Field of Classification Search ..... 473/378–385

See application file for complete search history.

(56) References Cited

U.S. PATENT DOCUMENTS 5,562,552 A * 10/1996 Thurman ..... 473/379

* cited by examiner

*Primary Examiner*—Raeann Trimiew
(74) *Attorney, Agent, or Firm*—St. Onge Steward Jonston & Reens LLC

(57) ABSTRACT

Disclosed is a dimple pattern on a golf ball, which consists of a plurality of dimples of various sizes for providing an optimum impact at the moment of hitting the golf ball. The dimple pattern formed on a circumferential surface of a golf ball has a total of 1070 dimples, including first dimples with a diameter of 3.8 mm, second dimples with a diameter of 3.2 mm, third dimples with a diameter of 2.4 mm, and fourth dimples with a diameter of 0.9 mm, wherein the number of the first dimples is 414, and the total number of the second to fourth dimples is 656. As the dimples of various sizes are repeatedly arranged with predetermined spaces, impact pressure is uniformly transferred to the golf ball over an entire contact area with a club face at the moment a golf club impacts on the golf ball, thereby removing the hook and slice, so that the straightness and stability of the golf ball while the golf ball is flying can be improved and the flight distance of the golf ball can be increased.

6 Claims, 7 Drawing Sheets

DIMPLE PATTERN ON GOLF BALL

The present application claims priority of Korean Patent Application No. 10-2005-0043133 filed May 23, 2005, the content of which is incorporated herein by reference.

FIELD OF THE INVENTION

The present invention relates to a dimple pattern on a golf ball, and in particular to a dimple pattern on a golf ball, which consists of a plurality of dimples of various sizes, wherein the dimples with different diameters are alternately or repeatedly arranged over the entire area of the circumferential surface of the golf ball with predetermined spaces, so that when the golf ball is hit by a golf club, impact pressure is transferred to the golf ball over a contact area with the club face at the moment the club face impacts on the golf ball, thereby providing an optimum impact and removing hook and slice at the time of hitting the golf ball, which can result in improved straightness and stability for the golf ball while the golf ball is flying, thereby increasing the flight distance of the golf ball.

BACKGROUND OF THE INVENTION

In general, while a golf ball is flying, the golf ball subjects to frictional resistance in its front side and shape resistance in its rear side. The frictional resistance is applied to the golf ball due to the friction between the golf ball and air, and the shape resistance is applied to the golf ball due to the swirling of air which occurs behind the golf ball while the golf ball is flying.

Among the above-mentioned resistances, the shape resistance functions as a main factor of deteriorating the characteristics in trajectory and flight distance of a golf ball; in order to reduce the shape resistance, a plurality of recesses, so called "dimples," are formed on the circumferential surface of the golf ball.

The air flow flowing around a dimpled golf ball is relatively slow as compared with that flowing around a non-dimpled golf ball; as a result, a swirling or backward flow generation area is reduced in such a dimpled golf ball, which is formed behind the golf ball while the golf ball is flying, whereby the shape resistance, which occurs as the backward air flow draws the golf ball in a direction opposite to the flight direction of the golf ball, can be lowered.

A conventional golf ball 1 also has a plurality of dimples 5 (e.g., in total of about 450 dimples) on the circumferential surface thereof as shown in FIG. 1, so as to reduce the above-mentioned shape resistance.

However, the conventional dimpled golf ball has a wide contact area, which will come into contact with the club face of a golf club 2, the contact area being formed between the dimples; due to the arrangement of the dimples, impact pressure is not uniformly to the golf ball over the entire contact surface on the golf ball with the club face at the moment the club face impacts on the golf ball. As a result, the impact angle is varied each time the golf ball is hit by the golf club, whereby it is very difficult to accurately hit such a golf ball.

In addition, the above-mentioned conventional dimpled golf ball has a disadvantage in that it cannot fly so far, because when it is hit by a golf club, it subjects to not only a high frictional resistance, which occurs due to air running against the front side thereof, but also a relatively high shape resistance, which occurs behind it, while it is flying.

SUMMARY OF THE INVENTION

Accordingly, the present invention has been made to solve the above-mentioned problems occurring in the prior art, and an object of the present invention is to provide a dimple pattern on a golf ball, which is formed by a plurality of dimples of various sizes, wherein the dimples with different diameters are alternately or repeatedly arranged over the entire area of the golf ball with a predetermined distance between two adjacent dimples in such a manner that when the golf ball is hit by a golf club, impact pressure is uniformly transferred to the golf ball over the entire contact area on the golf ball with the club face at the moment the club face impacts on the golf ball, thereby providing an optimum impact and removing hook and slice at the time of hitting the golf ball, which can result in improved straightness and stability for the golf ball while the golf ball is flying, thereby increasing the flight distance of the golf ball.

In order to achieve the above-mentioned object, there is provided a dimple pattern on a golf ball, which consists of a plurality of dimples of various sizes for providing an optimum impact at the moment of hitting the golf ball, the dimple pattern comprising: a first directional dimple arrangement having a plurality of first columns and second columns, which are alternately arranged, wherein each of the first columns is formed by a plurality of first dimples, second dimples and third dimples, which are repeatedly arranged in a predetermined sequence, and each of the second columns is formed by a plurality of fourth dimples, which are repeatedly arranged in pairs; a second directional dimple arrangement having a plurality of first rows and second rows, which are alternately arranged, wherein each of the first rows is formed by a plurality of the first dimples, second dimples, and third dimples, which are repeatedly arranged in a predetermined sequence, and each of the second rows is formed by a plurality of the fourth dimples, which are repeatedly arranged in pairs; a third directional dimple arrangement having a plurality of third rows, fourth rows and fifth rows, which are alternately arranged in such a manner that a fourth row and a fifth row are positioned between two adjacent third rows, wherein each of the third rows is formed by a plurality of the first dimples and fourth dimples, which are repeatedly arranged in such a manner that two fourth dimples are positioned between two adjacent first dimples, each of the fourth rows is formed by a plurality of the second dimples and fourth dimples, which are repeatedly arranged in such a manner that two fourth dimples are positioned between two adjacent second dimples, and each of the fifth rows is formed by a plurality of the third dimples and fourth dimples, which are repeatedly arranged in such a manner that two fourth dimples are positioned between two adjacent third dimples; and a fourth directional dimple arrangement having a plurality of sixth rows and seventh rows which are alternately arranged, wherein each of the sixth rows is formed by a plurality of the first dimples and fourth dimples, which are repeatedly arranged in such a manner that two fourth dimples are positioned between two adjacent first dimples, and each of the seventh rows is formed by a plurality of the second dimples, third dimples and fourth dimples, which are repeatedly arranged in such a manner that two forth dimples are positioned between a second dimple and a third dimple, which are adjacent to each other.

According to another aspect of the present invention, there is provided a dimple pattern on a golf ball, which consists of a plurality of dimples of various sizes for providing an optimum impact at the moment of hitting the golf ball, wherein the dimple pattern comprises a plurality of first dimple arrays and second dimple arrays which are repeatedly arranged in a first direction, wherein each of the first dimple arrays is formed by four first dimples arranged in a rectangular format, one second dimple formed at the center of the rectangular format, and four fourth dimples formed between the one second dimple and the four first dimples, respectively, and each of the second dimple arrays is formed by four first dimples arranged in a rectangular format, one third dimple formed at the center of the rectangular format, and four fourth dimples formed between the one third format and the four first dimples, respectively, and wherein the dimple pattern further comprises a plurality of eighth rows, in each of which the first dimple arrays are repeatedly arranged, and a plurality of ninth rows, in each of which the second dimple arrays are repeatedly arranged, the eighth rows and ninth rows being alternately arranged in a second direction.

In a dimple pattern on a golf ball according to a preferred embodiment of the present invention, it is preferable that the first dimples have a diameter of 3.8 mm, the second dimples have a diameter of 3.2 mm, the third dimples have a diameter of 2.4 mm, and the fourth dimples have a diameter of 0.9 mm.

In a dimple pattern on a golf ball according to another embodiment of the present invention, it is preferable that the first dimples and the second dimples, which are aligned in a crosswise line or a diametric line, are arranged in a such manner that adjacent first and second dimples are spaced about 1.0 mm from each other, and the first dimples and the third dimples, which are aligned in a diametric line or a crosswise line, are arranged in such a manner that adjacent first and third dimples are spaced about 1.0 mm from each other.

In a dimple pattern on a golf ball according to another embodiment of the present invention, it is preferable that a total of 1070 dimples are arranged on a golf ball, in which the number of the first dimples is 414, and the total number of the second, third and fourth dimples is 656.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE INVENTION

Figure 1:
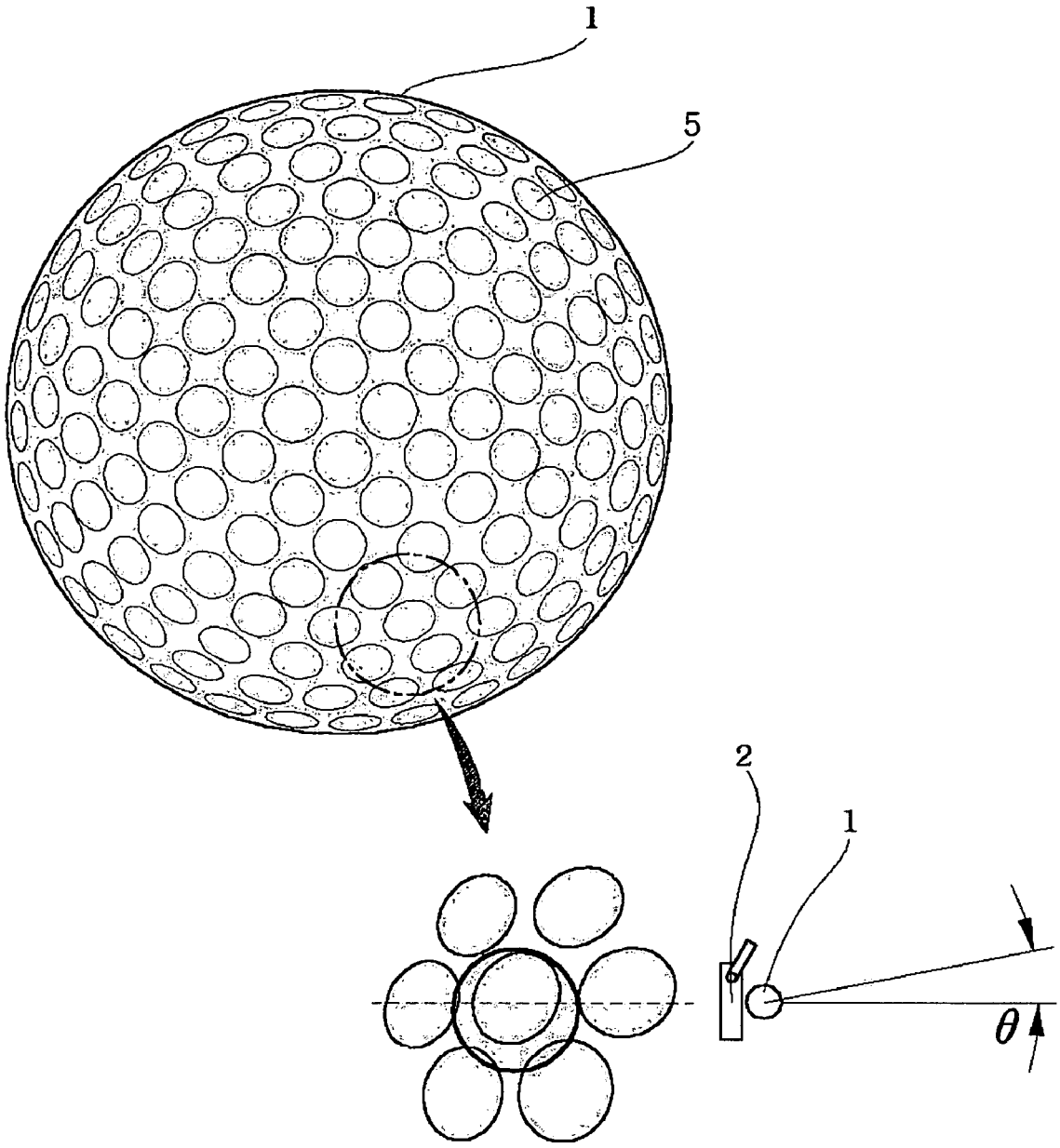
FIG. 1 shows a conventional dimple pattern on a golf ball, in which a part of the dimple pattern is separately shown in an enlarged scale.
Figure 2:
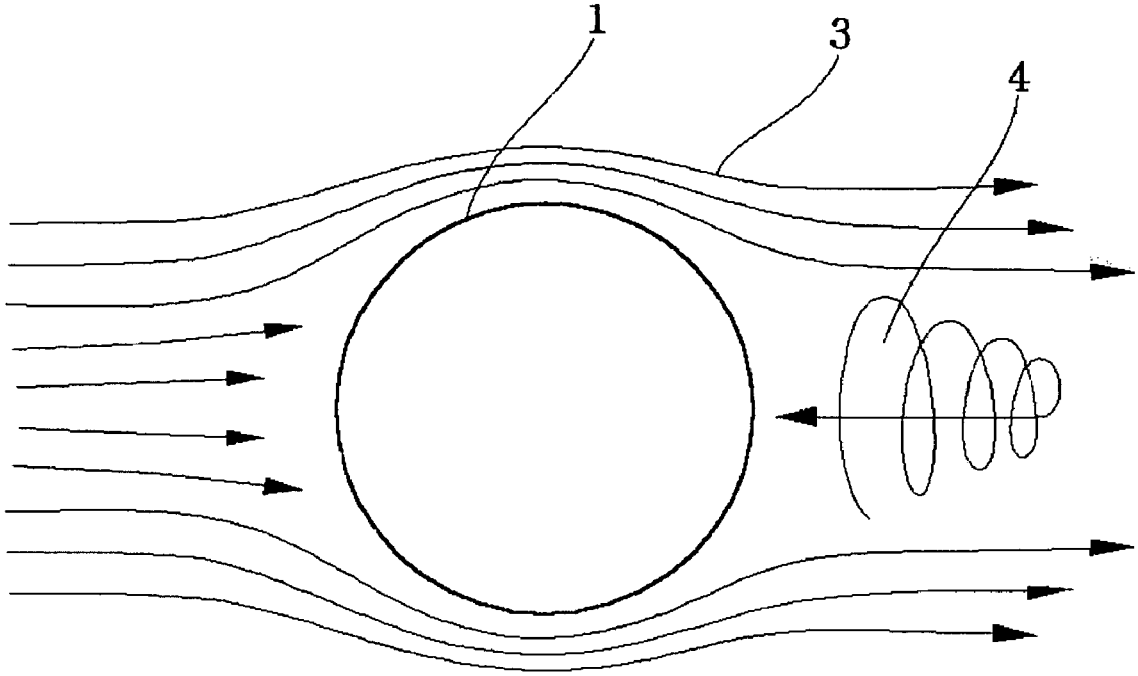
FIG. 2 schematically shows flow lines of air, which are formed around a golf ball with the dimple pattern of FIG. 1 while the golf ball is flying.

Hereinafter, preferred embodiments of the present invention will be described with reference to the accompanying drawings. In the following description and drawings, the same reference numerals are used to designate the same or similar components, so that repeated description on the same or similar components will be omitted.

Figure 3A:
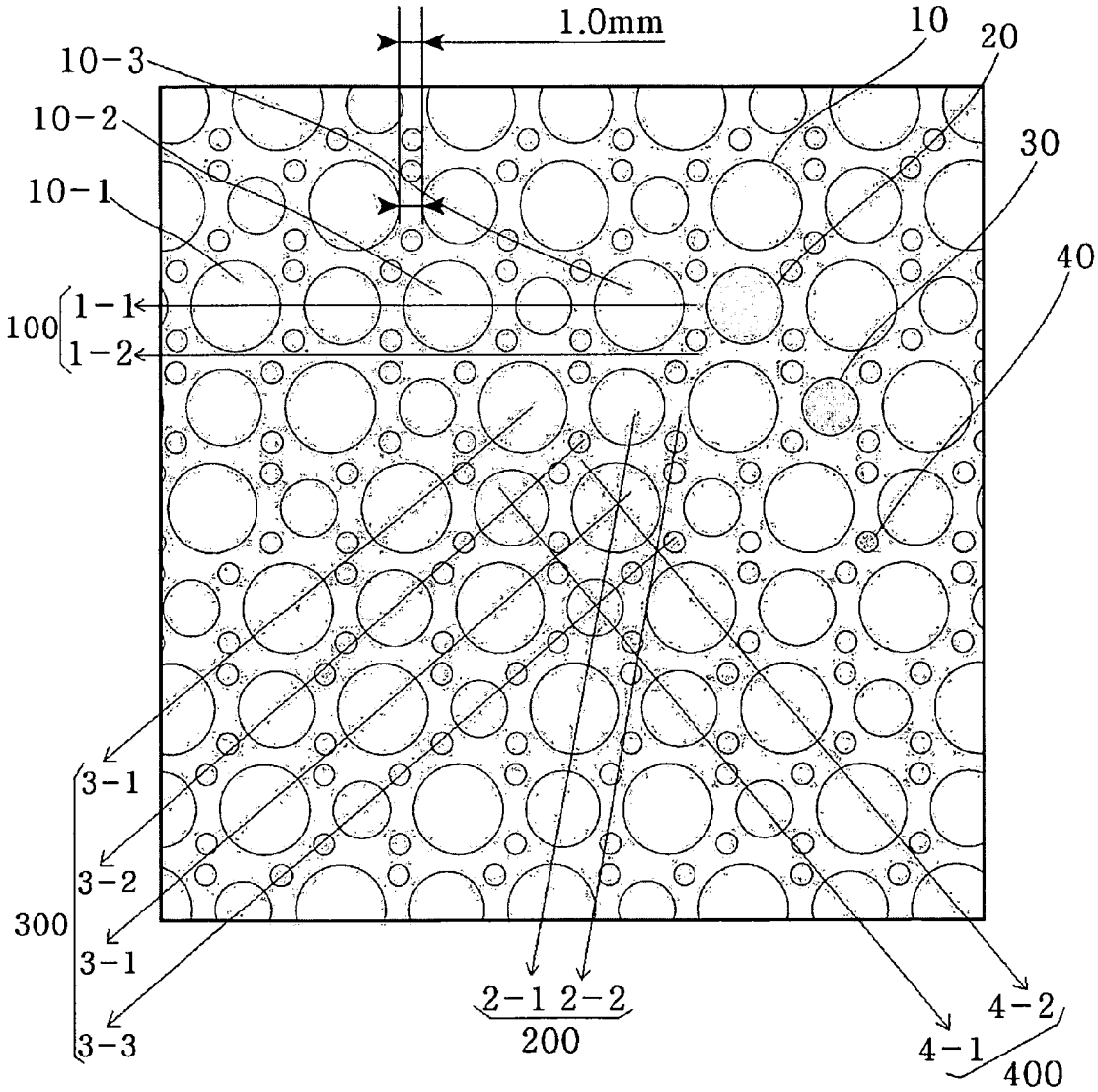
FIGS. 3*a* and 3*b* are deployment views showing the inventive dimple patterns on a golf ball.
Figure 3B:
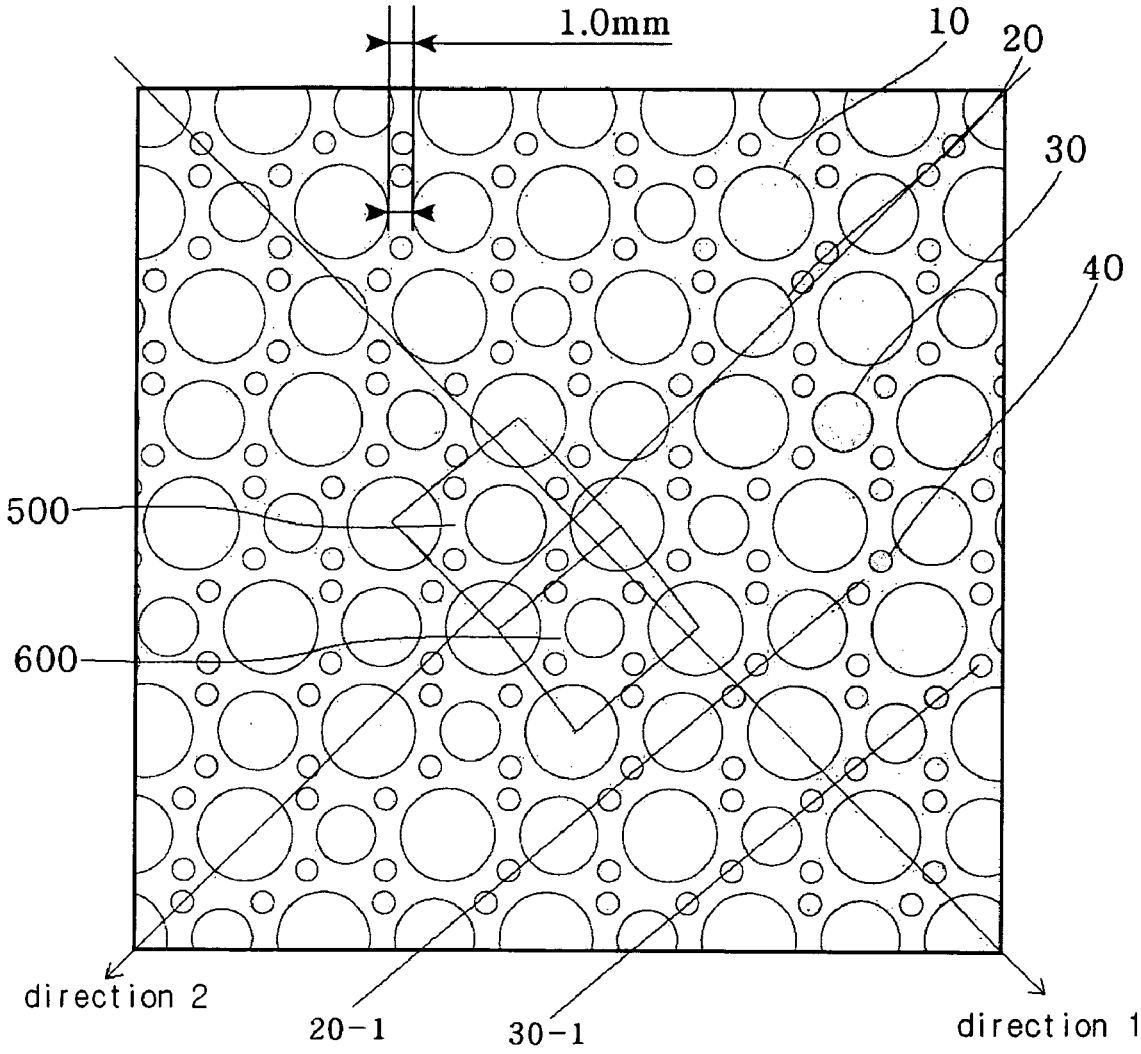
Figure 4:
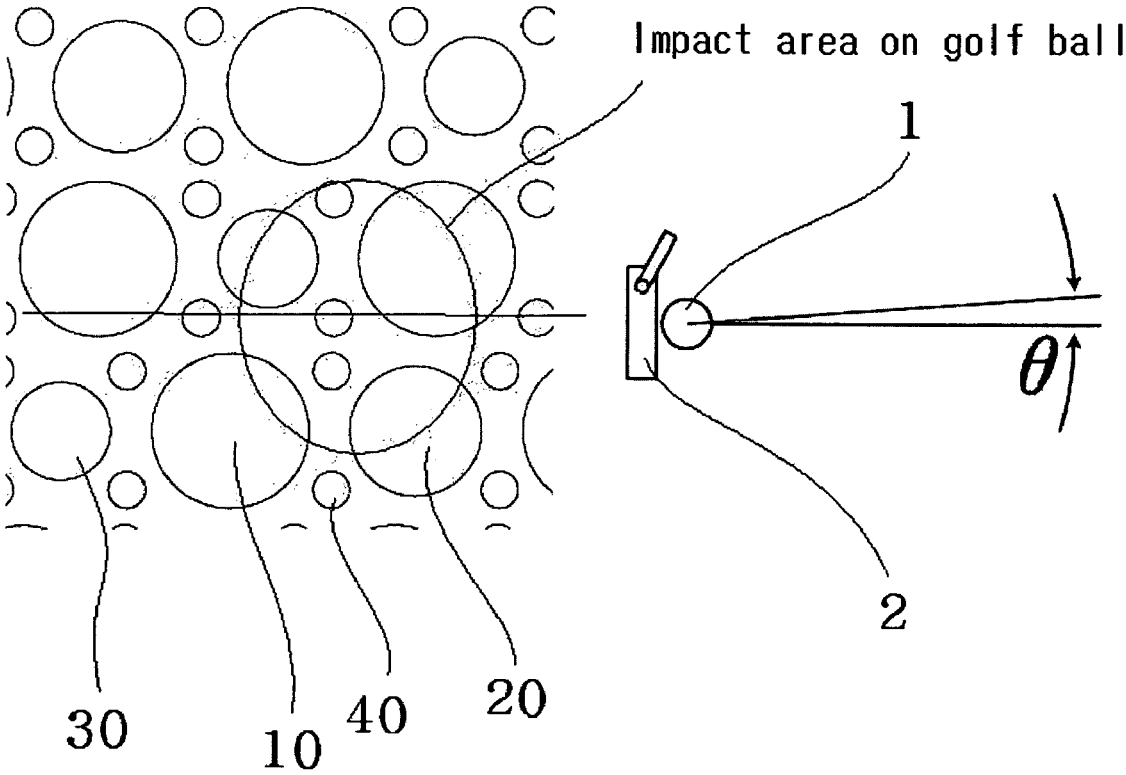
FIG. 4 schematically shows a state of a part of the inventive dimple pattern when a golf ball with the inventive dimple pattern is hit.
Figure 5:
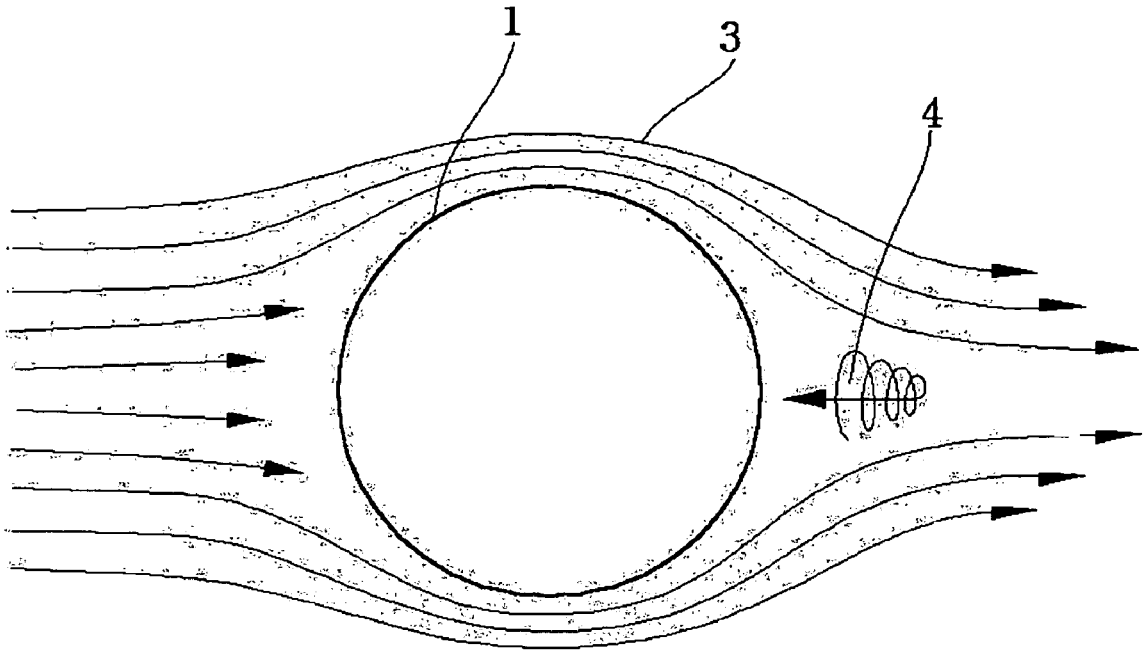
FIG. 5 schematically shows flow lines of air, which are formed around a golf ball with the inventive dimple pattern while the golf ball is flying.

FIGS. 3*a* and 3*b* are deployment views showing the inventive dimple patterns on a golf ball, FIG. 4 schematically shows a state of a part of the inventive dimple pattern when a golf ball with the inventive dimple pattern is hit, and FIG. 5 schematically shows flow lines of air, which are formed around a golf ball with the inventive dimple pattern while the golf ball is flying.

A dimple pattern on a golf ball according to an embodiment of the present invention consists of a first directional dimple arrangement 100, a second directional dimple arrangement 200, a third directional dimple arrangement 300, and a fourth directional dimple arrangement.

The first directional dimple arrangement 100 consists of a plurality of first columns 1-1 and second columns 1-2, which are alternately arranged in the first directional dimple arrangement 100.

Each of the first columns 1-1 is formed by first to third dimples, which are repeatedly arranged in such a manner that one second dimple 20 is positioned between a first dimple 10-1 and another first dimple 10-2, and one third dimple 30 is positioned between said another first dimple 10-2 and further another first dimple 10-3.

Each of the second columns 1-2 is formed by a plurality of fourth dimples 40 which are repeatedly arranged in pairs, in such a manner that among two adjacent pairs of the forth dimples, two fourth dimples 40 in one pair are obliquely arranged and relatively widely spaced from each other, and two forth dimples 40 in another pair are substantially vertically arranged and relatively narrowly spaced from each other, whereby the fourth dimples 40 in a second column 1-1 are respectively interposed between the first dimples 10-1, 10-2 and 10-3, the second dimples 20 and the third dimples 30 in two first columns 1-1, which are adjacent to the second column 1-2 from the upper and lower sides of the second column 1-2.

The second directional dimple arrangement 200 consists of a plurality of first rows 2-1 and second rows 2-2, which are alternately arranged in the second directional dimple arrangement 200.

Each of the first rows 2-1 is formed by a plurality of first to third dimples, which are repeatedly arranged in such a manner that one second dimple 20 is positioned between a first dimple 10-6 and another first dimple 10-7, and one third dimple 30 is positioned between said another first dimple 10-7 and further another first dimple 10-8.

Each of the second rows 2-2 is formed by a plurality of fourth dimples 40 which are arranged in pairs, in such a manner that among two adjacent pairs of the forth dimples, two fourth dimples 40 in one pair are obliquely arranged in relation to the first rows 2-1 and relatively widely spaced from each other, and two forth dimples 40 in another pair are arranged substantially parallel to the first rows 2-1 and relatively narrowly spaced from each other.

The third directional dimple arrangement 300 comprises a plurality of third rows 3-1, fourth rows 3-2, and fifth rows 3-3, which are alternately arranged in the third directional dimple arrangement 300.

Each of the third rows 3-1 is formed by a plurality of first dimples 10 and fourth dimples 40, which are repeatedly arranged in such a manner that a pair of fourth dimples 40 are positioned between two adjacent first dimples 10 and obliquely arranged in relation to a line passing the centers of the first dimples 10.

Each of the fourth rows 3-2 is formed by a plurality of second dimples 20 and fourth dimples 40, which are alternately and repeatedly arranged in such a manner that a pair of fourth dimples 40 are positioned between two adjacent second dimples 20 and arranged on a line passing the centers of the second dimples 20.

Each of the fifth rows 3-3 is formed by a plurality of third dimples 30 and fourth dimples 40, which are repeatedly arranged in such a manner that a pair of the fourth dimples 40 are positioned between two adjacent third dimples 30 and arranged on a line passing the centers of the third dimples 30.

Here, the third rows 3-1, the fourth rows 3-2 and the fifth rows 3-3 are alternately arranged in such a manner that one fourth row 3-2 and one fifth row 3-3 are positioned between two adjacent third rows 3-1.

The fourth directional dimple arrangement 400 consists of a plurality of sixth rows 4-1 and seventh rows 4-2, which are alternatively and repeatedly arranged in the fourth directional dimple arrangement 400.

Each of the sixth rows 4-1 is formed by a plurality of second dimples 20, third dimples 30, and fourth dimples 40, which are arranged in such a manner that the second dimples 20 and the third dimples 30 are alternately arranged and a pair of the fourth dimples 40 are arranged between adjacent second and third dimples 20 and 30.

Each of the seventh rows 4-2 is formed by a plurality of first dimples 10 and fourth dimples 40, which are alternately and repeatedly arranged in such a manner that a pair of the fourth dimples 40 are arranged between two adjacent first dimples 10 and, among two adjacent pairs of fourth dimples 40, two fourth dimples 40 in one pair are perpendicularly arranged in relation to a line passing the centers of the first dimples 10 and relatively widely spaced from each other, and two fourth dimples 40 in the other pair are slightly obliquely arranged in relation to the line passing the centers of the first dimples 10 and relatively narrowly spaced from each other.

A dimple pattern on a golf ball according to another embodiment of the present invention consists of a plurality of first dimple arrays 500 and second dimple arrays 600, as shown in FIG. 3*b*.

Each of the first dimple arrays 500 consists of four first dimples 10, one second dimple 20, and four fourth dimples 40. Here, the four first dimples 10 are arranged in a rectangular format, the one second dimple 20 is positioned at the center of the rectangular format, and the four fourth dimples 40 are arranged around the second dimple 20, so that the four fourth dimples 40 are positioned between the second dimple 20 and the first dimples 10, respectively, thereby forming another rectangular format.

Each of the second dimple arrays consists of four first dimples 10, one third dimple 30, and four fourth dimples 40. Here, the four first dimples 10 are arranged in a rectangular format, the one third dimple 30 is located at the center of the rectangular format, and the four fourth dimples 40 are arranged around the third dimple 30, so that the four fourth dimples 40 are positioned between the third dimple 30 and the four first dimples 10, respectively, thereby forming another rectangular format.

The above-mentioned first dimple arrays 500 and the second dimple arrays 600 are alternately and repeatedly arranged in the first direction.

However, unlikely in the first direction, the first dimple arrays 500 and the second dimple arrays 600 are not alternately arranged in the second direction; in each of eighth rows 20-1, the first dimple arrays 500 are continuously arranged, and each of ninth rows 30-1, the second dimple arrays 600 are continuously arranged.

One golf ball having a dimple pattern formed as described above includes a total of 1070 dimples, wherein the number of first dimples 10 is 414, and the total number of second to fourth dimples 20, 30 and 40 is 656.

In sizes of the first to fourth dimples 10, 20, 30 and 40, the first dimples 10 have a diameter of 3.8 mm, the second dimples 20 have a diameter of 3.2 mm, the third dimples 30 have a diameter of 2.4 mm, and the fourth dimples 40 have a diameter of 0.9 mm, wherein a first dimple 10 is spaced 1.0 mm either from an adjacent second dimple 20 or an adjacent third dimple 30 wherein the first to third dimples 10, 20 and 30 are aligned on a crosswise line or a diametric line.

As plural dimples having various sizes are formed in various arrangements, it is possible to increase the number of dimples on a golf ball to the maximum, which is allowed to be formed on the circumferential surface of a golf ball having an officially approved size.

The above-mentioned first dimples 10 suppress the frictional resistance of air, which occurs in front of the golf ball while the golf ball is flying, whereby the first dimples 10 serve to increase the lift of the golf ball, thereby lifting the golf ball.

The second to fourth dimples 20, 30 and 40 cause the air flow, which occurs in front of the golf ball while the golf ball is flying, to be continued to the rear side of the surface of the golf ball and render the flight trajectory of the golf ball straight and stable, thereby realizing an increase of flight distance. Further, the second to fourth dimples 20, 30 and 40 dramatically increase the entire area of the dimples on the golf ball, thereby reducing frictional resistance, so that the golf ball can fly a longer distance.

As shown in FIG. 4, upon hitting the golf ball having the above-mentioned dimple pattern, the face of a golf club comes into uniform contact with the golf ball in the upper and lower sides of the golf ball's surface at the moment of impacting on the golf ball, so that impact pressure is uniformly transferred to the golf ball over the entire contact area, whereby fine touch feeling and ball control could be provided to a player but hook and slice could be removed, thereby improving straightness and stability for the golf ball while the golf ball is flying. Moreover, as compared with a conventional golf ball as shown in FIG. 1, the departure angle θ of the golf ball can be optimized, so that the flight distance could be substantially increased.

As shown in FIG. 5, if a golf ball having a dimple pattern according to the present invention is hit, shape resistance, which occurs behind the golf ball while the golf ball is flying, is low, whereby the golf ball could fly over a relatively long distance.

Figure 6:
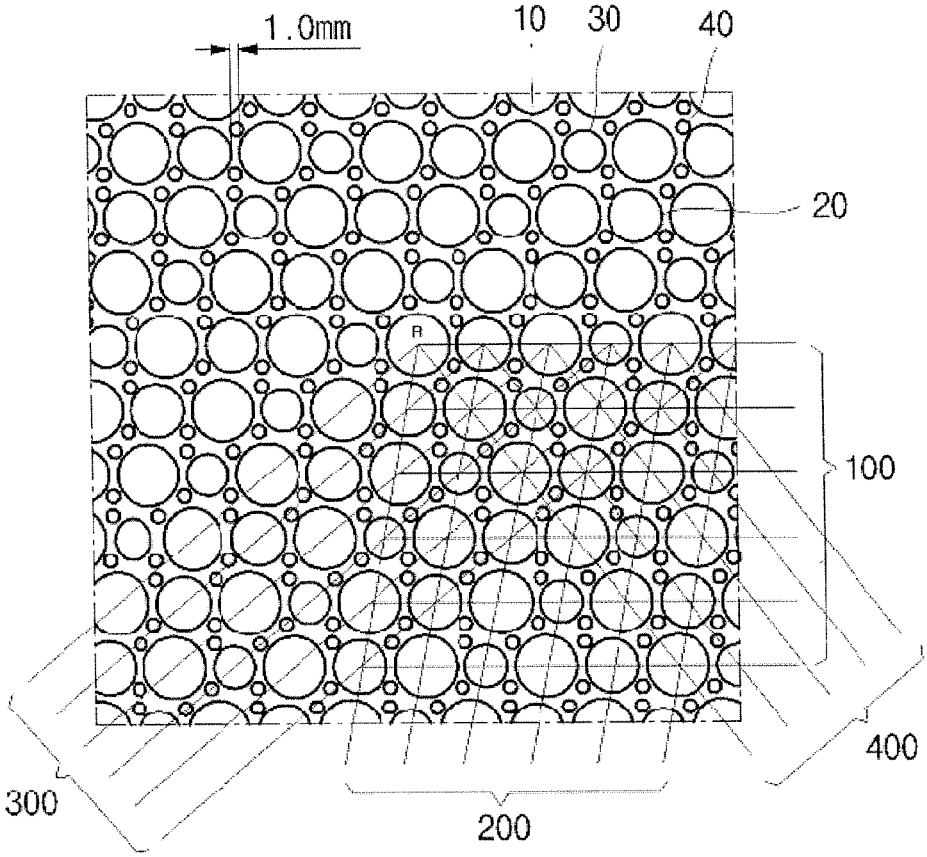
FIG. 6 is a deployment view showing the inventive dimple pattern on a golf ball.

A dimple pattern on a golf ball according to one embodiment of the invention shown in FIG. 6 consists of a plurality of dimples of various sizes for providing an optimum impact at the moment of hitting the golf ball.

The dimple pattern comprises a first directional dimple arrangement 100 formed in a linear structure of dimples, which are repeatedly arranged so as to have the uniformed pattern horizontally, referring as to the biggest one of the dimples on a golf ball as an R; a second directional dimple arrangement 200 formed in a linear structure of dimples, which are repeatedly arranged so as to have the uniformed pattern vertically; a third directional dimple arrangement 300 formed in a linear structure of dimples, which are repeatedly arranged in a direction of left downwards in case that contact points between the first directional dimple arrangement 100 and a second directional dimple arrangement 200 are connected to each other so as to form a slope structure in direction of left downwards and right downwards; and a fourth directional dimple arrangement 400 formed in a linear structure of dimples in the direction of right downwards, which are repeatedly arranged.

The above embodiment is characterized in that the first directional dimple arrangement 100 makes a first dimple 10 with a big diameter as an R, and a second dimple 20 with a middle diameter, which is arranged between the first dimple 10 and the next first dimple 10, and a third dimple 30 with a small diameter, which is arranged between a first dimple 10 next to the second dimple 20 and the further next dimple 10, are repeatedly arranged. Wherein the second directional dimple arrangement 200 refers a first dimple 10 as an R, and the second dimple 20 with a middle diameter, arranged between the first dimple 10 and the next first dimple 10, and a third dimple 30 with a small size diameter, arranged between the first dimple 10 next to the second dimple 20 and the further next dimple 10, are repeatedly arranged.

The third directional dimple arrangement 300 refers the first dimple 10 as R, and the first dimple 10, the second dimple 20, the first dimple 10 and the third dimple 30 are repeatedly arranged in a linear structure with the same size to each other. The fourth directional dimple arrangement 400 refers the first dimple 10 as an R, while the first dimple 10 is repeatedly arranged in a linear structure with the same size; the dimples next to the second dimple 20 and the third dimple 30 are alternately the third dimple 30 and the second dimple 20.

In respective dimples consisting of the first ~ fourth directional dimple arrangements 100~ 400, the smallest fourth dimples 40 are arranged between the first directional dimple arrangement 100 in a row and the second directional dimple arrangement 200 formed in a column. Wherein the one dimple is in a slope structure and the other is in a vertical structure, which dimples are alternately repeated. The fourth dimple 40 left downward from the R, arranged between the third directional arrangement 300, is in a vertical structure, while the four dimple 40 right downward from the R, arranged between the fourth directional arrangement 400, is in a slope structure.

Consequently, as compared with a conventional dimpled golf ball with a small number of dimples, the inventive golf ball could minimize frictional resistance and shape resistance, which occur in front of and behind the golf ball, respectively, when the golf ball is hit and flies, because the number of dimples arranged on the outer surface of the golf ball is substantially increased, whereby the flight distance of the golf ball can be increased.

As described above, if the inventive dimple pattern is employed on a golf ball, a large number of dimples of various sizes can be formed on the circumferential surface of the golf ball, whereby when the golf ball is hit by a golf club, impact pressure is uniformly transferred to the golf ball over the entire contact area on the golf ball with the club face at the moment the club face impacts on the golf ball, thereby providing an optimum impact and improving straightness and stability for the golf ball while the golf ball is flying, so that the flight distance of the golf ball can be increased.

Although several preferred embodiments of the present invention have been described for illustrative purposes, those skilled in the art will appreciate that various modifications, additions and substitutions are possible, without departing from the scope and spirit of the invention as disclosed in the accompanying claims.

The invention claimed is:

1. A dimple pattern on a golf ball, which consists of a plurality of dimples of various sizes for providing an optimum impact at the moment of hitting the golf ball, the dimple pattern comprising:

a first directional dimple arrangement having a plurality of first columns and second columns, which are alternately arranged, wherein each of the first columns is formed by a plurality of first dimples, second dimples and third dimples, which are repeatedly arranged, and each of the second columns is formed by a plurality of fourth dimples, which are repeatedly arranged in pairs;

a second directional dimple arrangement having a plurality of first rows and second rows, which are alternately arranged, wherein each of the first rows is formed by a plurality of the first dimples, second dimples, and third dimples, which are repeatedly arranged, and each of the second rows is formed by a plurality of the fourth dimples, which are repeatedly arranged in pairs;

a third directional dimple arrangement having a plurality of third rows, fourth rows and fifth rows, which are alternately arranged in such a manner that a fourth row and a fifth row are positioned between two adjacent third rows, wherein each of the third rows is formed by a plurality of the first dimples and fourth dimples, which are repeatedly arranged in such a manner that two fourth dimples are positioned between two adjacent first dimples, each of the fourth rows is formed by a plurality of the second dimples and fourth dimples, which are repeatedly arranged in such a manner that two fourth dimples are positioned between two adjacent second dimples, and each of the fifth rows is formed by a plurality of the third dimples and fourth dimples, which are repeatedly arranged in such a manner that two fourth dimples are positioned between two adjacent third dimples; and a fourth directional dimple arrangements having a plurality of sixth rows and seventh rows which are alternately arranged, wherein each of the sixth rows is formed by a plurality of the first dimples and fourth dimples, which are repeatedly arranged in such a manner that two fourth dimples are positioned between two adjacent first dimples, and each of the seventh rows is formed by a plurality of the second dimples, third dimples and fourth dimples, which are repeatedly arranged in such a manner that two forth dimples are positioned between a second dimple and a third dimple, which are adjacent to each other;

wherein diameter of first dimples is not identical to diameter of seconds dimples, diameter of third dimples, or diameter of fourth dimples;

wherein diameter of second dimples is not identical to diameter of third dimples, or diameter of fourth dimples; and wherein diameter of third dimples is not identical to diameter of fourth dimples.

2. A dimple pattern as claimed in claim 1, wherein the fourth dimples are arranged in the second columns of the first directional dimple arrangement and in the second rows of the second directional dimple arrangement, in such a manner that in two adjacent pairs of the fourth dimples, two fourth dimples in one pair are relatively narrowly spaced from each other and two fourth dimples in the other pair are relatively widely spaced from each other and such two pairs are repeatedly arranged in the second columns and in the second rows.

3. A dimple pattern on a golf ball, which consists of a plurality of dimples of various sizes for providing an optimum impact at the moment of hitting the golf ball, the dimple pattern comprising:

a first directional dimple arrangement having a plurality of first columns and second columns, which are alternately arranged, wherein each of the first columns is formed by a plurality of first dimples, second dimples and third dimples, which are repeatedly arranged, and each of the second columns is formed by a plurality of fourth dimples, which are repeatedly arranged in pairs;

a second directional dimple arrangement having a plurality of first rows and second rows, which are alternately arranged, wherein each of the first rows is formed by a plurality of the first dimples, second dimples, and third dimples, which are repeatedly arranged, and each of the second rows is formed by a plurality of the fourth dimples, which are repeatedly arranged in pairs;

a third directional dimple arrangement having a plurality of third rows, fourth rows and fifth rows, which are alternately arranged in such a manner that a fourth row and a fifth row are positioned between two adjacent third rows, wherein each of the third rows is formed by a plurality of the first dimples and fourth dimples, which are repeatedly arranged in such a manner that two fourth dimples are positioned between two adjacent first dimples, each of the fourth rows is formed by a plurality of the second dimples and fourth dimples, which are repeatedly arranged in such a manner that two fourth dimples are positioned between two adjacent second dimples, and each of the fifth rows is formed by a plurality of the third dimples and fourth dimples, which are repeatedly arranged in such a manner that two fourth dimples are positioned between two adjacent third dimples; and a fourth directional dimple arrangement having a plurality of sixth rows and seventh rows which are alternately arranged, wherein each of the sixth rows is formed by a plurality of the first dimples and fourth dimples, which are repeatedly arranged in such a manner that two fourth dimples are positioned between two adjacent first dimples, and each of the seventh rows is formed by a plurality of the second dimples, third dimples and fourth dimples, which are repeatedly arranged in such a manner that two forth dimples are positioned between a second dimple and a third dimple, which are adjacent to each other;

wherein the first dimples have a diameter of 3.8 mm, the second dimples have a diameter of 3.2 mm, the third dimples have a diameter of 2.4 mm, and the fourth dimples have a diameter of 0.9 mm.

4. A dimple pattern on a golf ball, which consists of a plurality of dimples of various sizes for providing an optimum impact at the moment of hitting the golf ball, the dimple pattern comprising:

a first directional dimple arrangement having a plurality of first columns and second columns, which are alternately arranged, wherein each of the first columns is formed by a plurality of first dimples, second dimples and third dimples, which are repeatedly arranged, and each of the second columns is formed by a plurality of fourth dimples, which are repeatedly arranged in pairs;

a second directional dimple arrangement having a plurality of first rows and second rows, which are alternately arranged, wherein each of the first rows is formed by a plurality of the first dimples, second dimples, and third dimples, which are repeatedly arranged, and each of the second rows is formed by a plurality of the fourth dimples, which are repeatedly arranged in pairs;

a third directional dimple arrangement having a plurality of third rows, fourth rows and fifth rows, which are alternately arranged in such a manner that a fourth row and a fifth row are positioned between two adjacent third rows, wherein each of the third rows is formed by a plurality of the first dimples and fourth dimples, which are repeatedly arranged in such a manner that two fourth dimples are positioned between two adjacent first dimples, each of the fourth rows is formed by a plurality of the second dimples and fourth dimples, which are repeatedly arranged in such a manner that two fourth dimples are positioned between two adjacent second dimples, and each of the fifth rows is formed by a plurality of the third dimples and fourth dimples, which are repeatedly arranged in such a manner that two fourth dimples are positioned between two adjacent third dimples; and a fourth directional dimple arrangement having a plurality of sixth rows and seventh rows which are alternately arranged, wherein each of the sixth rows is formed by a plurality of the first dimples and fourth dimples, which are repeatedly arranged in such a manner that two fourth dimples are positioned between two adjacent first dimples, and each of the seventh rows is formed by a plurality of the second dimples, third dimples and fourth dimples, which are repeatedly arranged in such a manner that two forth dimples are positioned between a second dimple and a third dimple, which are adjacent to each other;

wherein the first dimples and the second dimples, which are aligned in a crosswise line or a diametric line, are arranged in a such manner that a first dimple and a second dimple, which are adjacent to each other, are spaced about 1.0 mm from each other, and the first dimples and the third dimples, which are aligned in a diametric line or a crosswise line, are arranged in such a manner that a first dimple and a third dimple, which are adjacent to each other, are spaced about 1.0 mm from each other.

5. A dimple pattern on a golf ball, which consists of a plurality of dimples of various sizes for providing an optimum impact at the moment of hitting the golf ball, the dimple pattern comprising:

a first directional dimple arrangement having a plurality of first columns and second columns, which are alternately arranged, wherein each of the first columns is formed by a plurality of first dimples, second dimples and third dimples, which are repeatedly arranged, and each of the second columns is formed by a plurality of fourth dimples, which are repeatedly arranged in pairs;

a second directional dimple arrangement having a plurality of first rows and second rows, which are alternately arranged, wherein each of the first rows is formed by a plurality of the first dimples, second dimples, and third dimples, which are repeatedly arranged, and each of the second rows is formed by a plurality of the fourth dimples, which are repeatedly arranged in pairs;

a third directional dimple arrangement having a plurality of third rows, fourth rows and fifth rows, which are alternately arranged in such a manner that a fourth row and a fifth row are positioned between two adjacent third rows, wherein each of the third rows is formed by a plurality of the first dimples and fourth dimples, which are repeatedly arranged in such a manner that two fourth dimples are positioned between two adjacent first dimples, each of the fourth rows is formed by a plurality of the second dimples and fourth dimples, which are repeatedly arranged in such a manner that two fourth dimples are positioned between two adjacent second dimples, and each of the fifth rows is formed by a plurality of the third dimples and fourth dimples, which are repeatedly arranged in such a manner that two fourth dimples are positioned between two adjacent third dimples; and a fourth directional dimple arrangement having a plurality of sixth rows and seventh rows which are alternately arranged, wherein each of the sixth rows is formed by a plurality of the first dimples and fourth dimples, which are repeatedly arranged in such a manner that two fourth dimples are positioned between two adjacent first dimples, and each of the seventh rows is formed by a plurality of the second dimples, third dimples and fourth dimples, which are repeatedly arranged in such a manner that two forth dimples are positioned between a second dimple and a third dimple, which are adjacent to each other;

wherein a total of 1070 dimples are arranged on a golf ball, in which the number of the first dimples is 414, and the total number of the second, third and fourth dimples is 656.

6. A dimple pattern on a golf ball, which consists of a plurality of dimples of various sizes for providing an optimum impact at the moment of hitting the golf ball, the dimple pattern comprising:

a first directional dimple arrangement formed in a linear structure of dimples, which are repeatedly arranged so as to have the uniformed pattern horizontally, referring as to the biggest one of the dimples on a golf ball as R;

a second directional dimple arrangement formed in a linear structure of dimples, which are repeatedly arranged so as to have the uniformed pattern vertically;

a third directional dimple arrangement formed in a linear structure of dimples, which are repeatedly arranged in a direction of left downwards in case that contact points between the first direction dimple arrangement and a second direction dimple arrangement are connected to each other so as to form a slope structure in direction of left downwards and right downwards;

and a fourth directional dimple arrangement formed in a linear structure of dimples in the direction of right downwards, which are repeatedly arranged;

characterized in that the first directional dimple arrangement makes a first dimple with a big diameter as a R, and a second dimple with a middle diameter, which is arranged between the first dimple and the next first dimple, and a third dimple with a small diameter, which is arranged between a first dimple next to the second dimple and the further next dimple, are repeatedly arranged;

wherein the second directional dimple arrangement refers a first dimple as a R, and the second dimple with a middle diameter, arranged between the first dimple and the next first dimple, and a third dimple with a small size diameter, arranged between the first dimple next to the second dimple and the further next dimple, are repeatedly arranged;

the third directional dimple arrangement refers the first dimple as R, and the first dimple, the second dimple, the first dimple and the third dimple are repeatedly arranged in a linear structure with the same size to each other;

the fourth directional dimple arrangement refers to the first dimple as a R, while the first dimple is repeatedly arranged in a linear structure with the same size, the dimples next to the second dimple and the third dimple are alternately the third dimple and the second dimple;

in respective dimples consisting of the first, second, third, and fourth directional dimple arrangements, the smallest fourth dimples are arranged between the first directional dimple arrangement in a row and the second directional dimple arrangement formed in a column;

wherein the one dimple is in a slope structure and the other is in a vertical structure, which dimples are alternatively repeated;

the fourth dimple left down from the R, arranged between the third directional arrangement, is in a vertical structure, while the four dimple right downward from the R, arranged between the fourth directional arrangement, is in a slope structure.

* * * * *